US005292272A

United States Patent [19]

Grim

[11] Patent Number: 5,292,272

[45] Date of Patent: Mar. 8, 1994

[54] DUAL MODE SWIM FIN

[76] Inventor: Roger W. Grim, 815 N. Main St., Lafayette, Ga. 30728

[21] Appl. No.: 84,342

[22] Filed: Jun. 28, 1993

[51] Int. Cl.[5] ..... A63B 31/11

[52] U.S. Cl. ..... 441/62; 441/64

[58] Field of Search ..... 441/55, 61-64

[56] References Cited

U.S. PATENT DOCUMENTS

| | | | |
|---|---|---|---|
| 2,903,718 | 9/1959 | Wozencraft | 9/21 |
| 3,068,499 | 12/1962 | von Biskupsky | 441/63 |
| 3,268,927 | 8/1966 | Markowitz | 9/304 |
| 4,752,259 | 6/1988 | Tackett et al. | 441/64 |
| 4,981,454 | 1/1991 | Klein | 441/62 |

FOREIGN PATENT DOCUMENTS

| | | | |
|---|---|---|---|
| 2565498 | 12/1985 | France | A63B 31/11 |
| 533240 | 9/1955 | Italy . | |
| 1189460 | 11/1985 | U.S.S.R. | A63B 31/08 |
| 2197796 | 6/1988 | United Kingdom | 441/64 |

*Primary Examiner*—Sherman Basinger
*Attorney, Agent, or Firm*—Alan Ruderman

[57] ABSTRACT

A swim fin for use in a swimming mode and in a walking mode has a boot portion including a shoe having a foot receiving pocket and a bulbous connecting member. Three tracks are formed in the connecting member terminating in a cavity at each end of each track, the cavity at one end being disposed substantially parallel to the axis of elongation of the foot receiving pocket and thus the foot of a swimmer and the cavity at the other end of each track being disposed approximately 90° to the axis of the foot receiving pocket. The fin also includes a web having fingers adapted to be received in the cavities at one end of the tracks or in the cavities at the other end of the tracks selectively when the web is positioned in the swimming mode or the walking mode. The web also carries pins which are resiliently connected to the boot portion of the fin and positioned within a guideway in the connecting member. The configuration of the guideway is such as to urge the fingers into one or the other sets of cavities. The fingers may be positioned in one set or the other of the cavities by pulling the web to remove the fingers from one set of the cavities and repositioning the web with the fingers positioned in the other set of cavities.

10 Claims, 3 Drawing Sheets

DUAL MODE SWIM FIN

BACKGROUND OF THE INVENTION

This invention relates to swim fins and more particularly to swim fins which may be used effectively for swimming and for walking.

Swim fins are devices which are worn on a swimmer's feet to provide an increased surface for acting on the water and to flexibly flutter in the water while the swimmer kicks. The fins thus permit the swimmer to generate greater propulsive force and efficiency while swimming. However, the fins are bulky and cumbersome when worn while walking on land because of the generally uninterrupted length of the fin from the mounting portion of the foot of the wearer to the free or forward end of the web or blade of the fin. Conventional fins are thus impracticable for use while walking and must be installed at the water's edge and removed when exiting from the water.

Various proposals have been made in the prior art to provide swimming fins which may be less cumbersome when walking than conventional fins. Many of the proposals are complex or provide ineffective means for locking the web of the fin in either or both the swimming or walking mode. Exemplary of this prior art are Wozencraft U.S. Pat. No. 2,903,718 which merely unlatches a portion of the fin and permits it to swing so as to drag behind the swimmer's foot; Markowitz U.S. Pat. No. 3,268,927 which requires a large awkward boot for carrying a strut on which a lever is pivoted; Tackett et al U.S. Pat. No. 4,752,259 which hinges the web so that it pivots onto or under the foot where it is held by magnets; Klein U.S. Pat. No. 4,981,454 which pivotably hinges the web but does not latch it in the walking position; Italian Patent No. 533,240 which hinges and pivots the web from a latched swimming position but requires a brace about the leg to hold it in the walking position; French application No. 2,565,498 which uses a lever to pivot the web; and Russian Inventor's Certificate No. 1,189,460A which hinges the web and pivots it against the action of an over-center spring.

In none of the known prior art proposals is there a positive locking of the web portion of the fin to the foot mounted portion in both the swimming and the walking mode while permitting the blade to flexibly flutter during the swimming mode. Accordingly, although a substantial number of proposals have been made to solve the aforesaid problem, these proposals have not provided feasible solutions and appear not to have been adopted commercially.

SUMMARY OF THE INVENTION

Consequently, it is a primary object of the present invention to provide a swim fin which is effective during swimming for increasing the propulsive force and efficiency of a swimmer in water and which may be converted readily to a walking mode.

It is another object of the present invention to provide a swim fin which may be readily used for swimming and for walking, the fin having a foot mounted portion and a web portion secured to the foot mounted portion and movable from an extended position for swimming to an upstanding position for walking and which is securely held in each position.

It is a further object of the present invention to provide a swim fin readily convertible between a swimming mode and a walking mode, the fin having a foot mounted boot portion and a movable web portion resiliently attached to the boot portion and securely held in position in both modes, the web portion having a plurality of fingers receivable within wells formed in the boot portion in both modes, the fin additionally having securing members positively urging the fingers into the wells in each mode and precluding disengagement of the web and fingers from the boot portion during transition from one mode to the other mode.

Accordingly, the present invention provides a swim fin which may be used effectively for swimming and for walking, the fin having a boot portion adapted to be worn on the foot of a person and a web portion resiliently attached to the boot portion and movable relative thereto. The web portion carries detent means resiliently connected to the boot portion positioned within a guideway in the boot portion, the detent means being urged into the guideway. The guideway has a pair of termini respectively corresponding to positions of the detent means where the web is disposed in an extended position relative to the boot portion and defining the swimming position of the web, and in an upstanding position relative to the boot portion and defining the walking position of the web.

The web or blade also includes a plurality of resilient fingers which are positioned within corresponding slots in the boot portion, each of the slots terminating in a well at each end for receiving the corresponding finger. When the web is disposed in the swimming position each of the fingers is disposed at one terminus of the slot and urged into the corresponding well, and when the web is disposed in the walking position each finger is disposed in the other terminus of the slot and urged into the other well. Thus, the fingers are securely retained and held within the respective wells when the detent means is disposed at a corresponding terminus of the guideway. The resilient force applied on the detent means draws the web toward the boot portion and the fingers into the respective wells.

In accordance with the preferred embodiment of the invention there are two guideways spaced laterally apart in the boot portion and the detent means comprises a pin disposed in a respective guideway, the pin being trapped in the web and urged by spring means into the guideway. The guideway is configured with a deep recess at each terminus so that the pin is drawn deeply into the boot portion when the web is in both the swimming position and the walking position. Thus, a substantial manual force must be exerted to disengage the fingers from the corresponding wells for repositioning the web portion between the swimming and the walking positions.

Another aspect of the invention is the application of additional holding means for retaining the fingers in the corresponding wells when the web is in the swimming position so that substantial kicking action may be applied by the swimmer without disengaging the fingers from the wells. A preferred form of the additional means comprises a magnet within the wells corresponding to the swimming mode and having the tips of the fingers constructed with ferrous metal embedded therein.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENT

Figure 1:
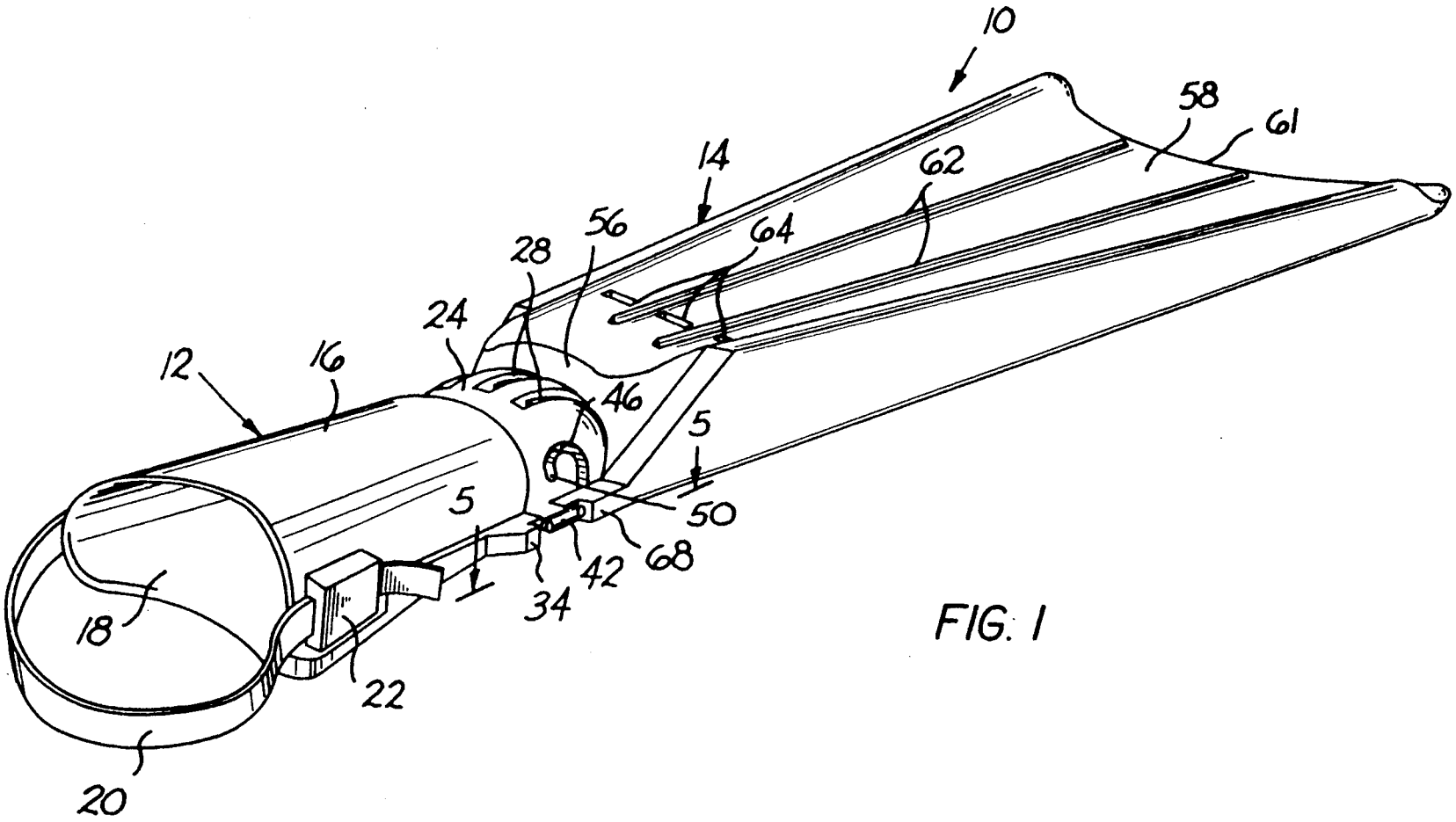
FIG. 1 is a perspective view of a swim fin constructed in accordance with the principles of the present invention, the web portion of the fin being disposed in the swimming position.

Referring now to the drawings, FIG. 1 illustrates a swim fin 10 constructed according to the present invention, the fin comprising a boot portion 12 and a web portion 14, each preferably constructed as by molding from rubber or other elastomeric material. The boot portion 12 includes a shoe 16 having a foot receiving opening 18. A strap 20 may be adjustably connected within a latch block 22 on the shoe if desired for securing the shoe tightly to the foot of a user of the fin.

Figure 2:
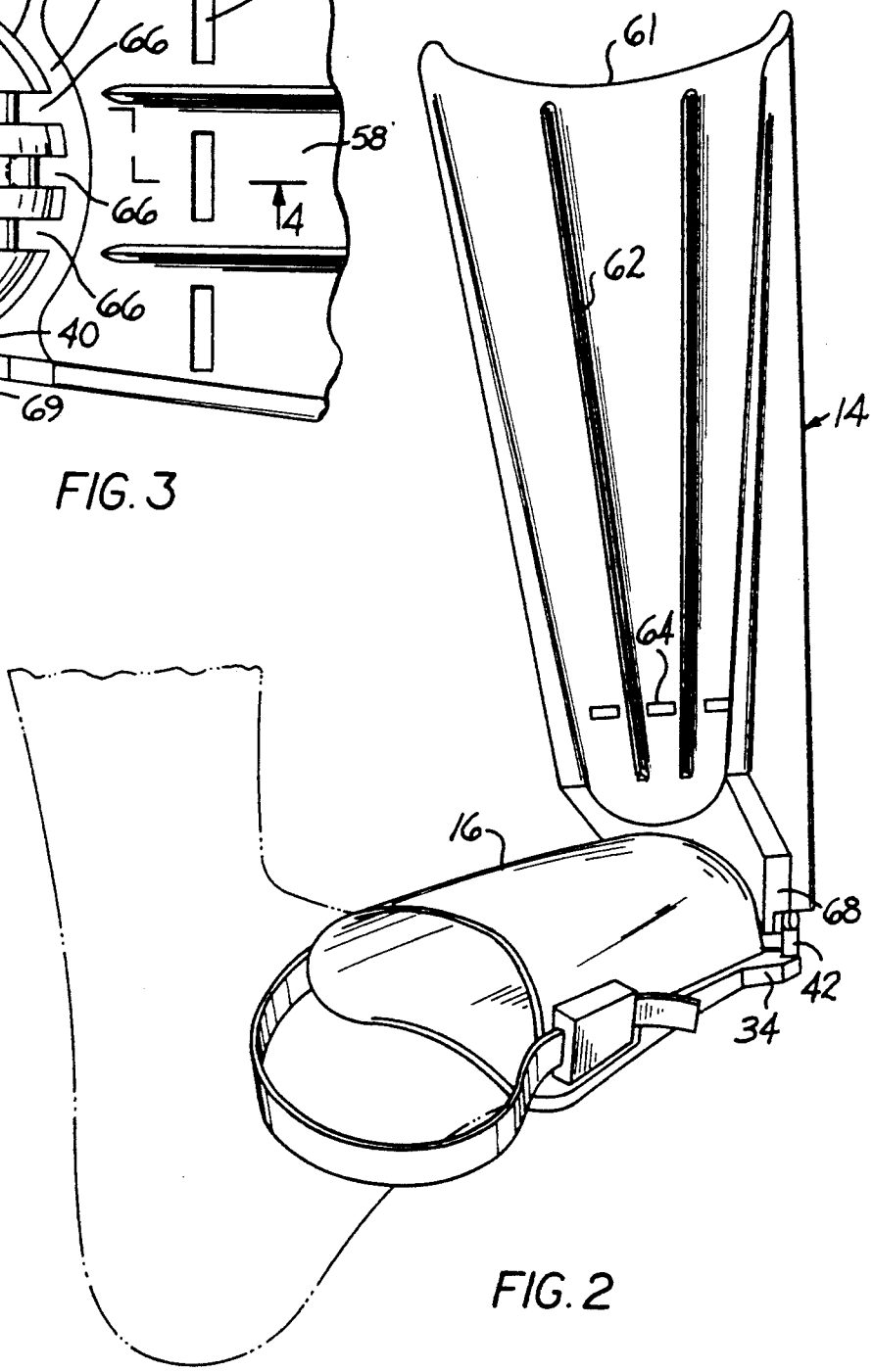
FIG. 2 :s a view similar to FIG. 1, but with the web disposed in the walking position.
Figure 4:
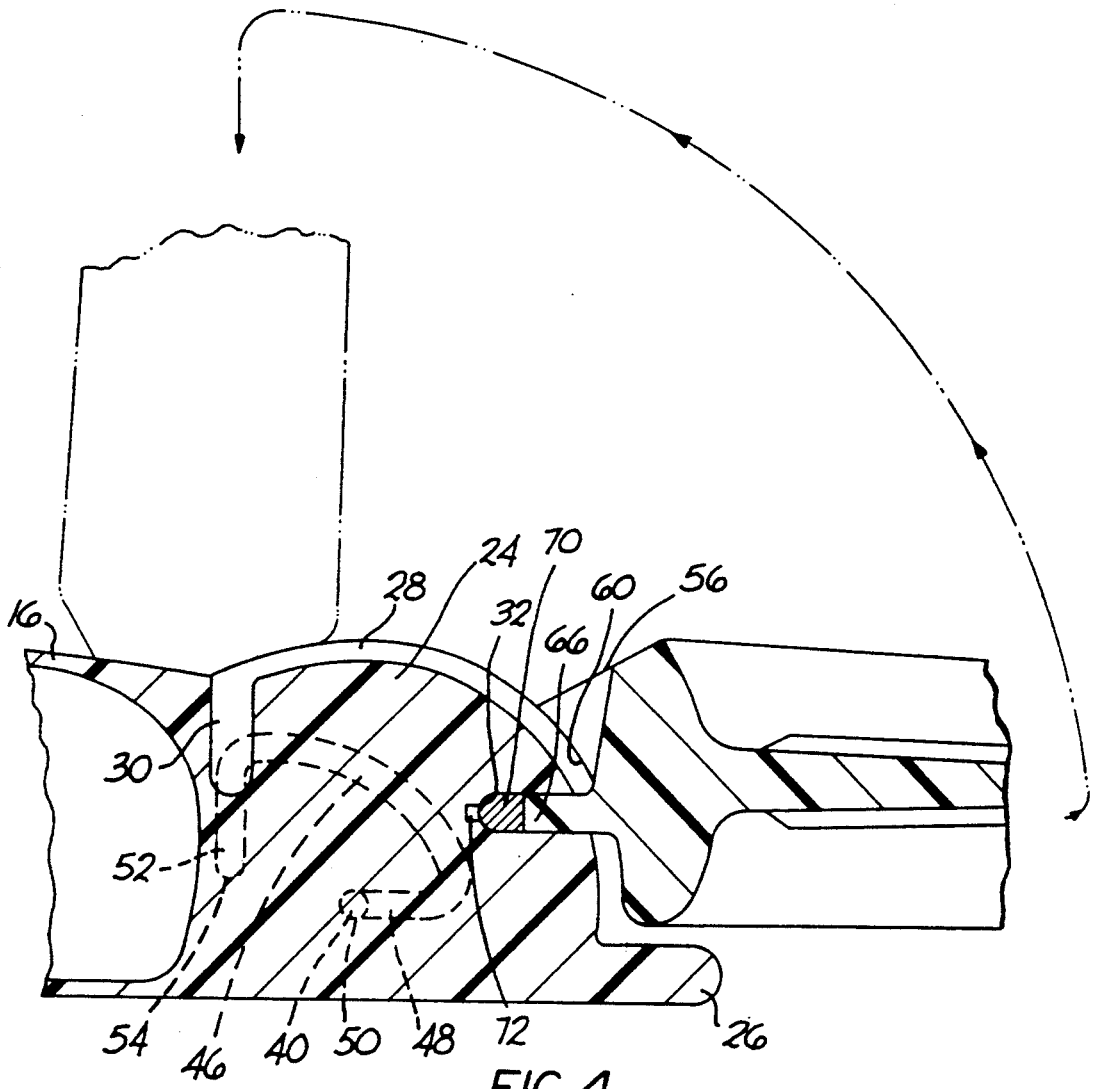
FIG. 4 is a cross sectional view taken substantially along line 4—4 of FIG. 3 and illustrating the manner in which the web is repositioned.

At the forward end of the shoe, i.e., the end remote from the foot receiving opening 18, formed integral with the shoe, is a bulbous section 24 having a substantially convex configuration which preferably may comprise a spherical segment. As hereinafter described, the web portion 14 is connected to the bulbous section 24 in a manner which permits it to move from a horizontally extended swimming position relative to the shoe, as illustrated in FIG. 1, to an upstanding walking position, as illustrated in FIG. 2, and to be effectively locked in position in each case. Thus, the bulbous section may be defined as a connecting section of the boot portion. Extending forwardly from the bottom-most part of the bulbous section 24 is a lip 26, illustrated in FIG. 4, which may act as a stabilizer for the web as it flutters relative to the boot portion during swimming.

Formed into the surface of the bulbous section 24 are a plurality of spaced apart slots or tracks 28, there preferably being three such tracks and, because of the arcuate configuration of the surface of the bulbous section 24, the tracks have arcuate configurations. The tracks each extend along the top of the section 24 from adjacent the shoe downwardly along the front of the section 24 to adjacent the lip 26. At each terminus of each track 28 there is a respective cavity 30, 32 recessed into the bulbous section, only one of the cavities 32 being illustrated, that being in FIG. 4. The cavities 30 extend into the bulbous section 24 in a substantially vertical disposition relative to the shoe 16 while the cavities 32 extend into the section 24 in a substantially horizontal disposition, i.e., the cavities 30, 32 are disposed in a direction equivalent to the disposition of the web portion when in the walking and swimming modes respectively.

Adjacent each side of the bulbous section 24 at the junction with the shoe 16 is an integral block 34 within which a pin 36 may be embedded, either prior to molding of the boot portion, or subsequently inserted. The pin 36 is hollow and has threads tapped therein for receiving a screw 37 having a head 39 disposed outside the pin 36. One end of a stainless steel coil spring 38 is looped about the screw 37 and clamped by the head 39 against the pin. The other end of the spring 38 is looped about a screw 41 threaded within a detent pin 40 embedded within the web portion 14, as hereinafter described, and clamped by the head 43 of the screw 41. The spring 38 is encased within a protective surgical rubber tube 42 to prevent foreign matter from hindering the operation of the spring, the purpose of which will hereinafter become clear. It may at this point be mentioned that the block 34 is formed to provide a recess 44 and that the tube 42 extends through this recess and may move from a horizontal to a vertical disposition when the web changes positions from the swimming mode to the walking mode as hereinafter described.

Recessed into each side of the bulbous section 24 adjacent the forward end thereof is a respective guideway 46 having a substantially arcuate configuration except at its ends. One end of the guideway has a leg 48 that extends substantially parallel to the cavities 32, i.e., leg 48 is substantially horizontally disposed extending in a direction away from the forward end of the bulbous section 24 toward the shoe 16 and has a terminus 50. At the other end the guideway 46 has a substantially vertically disposed leg extending downwardly substantially parallel to the cavities 30 and has a terminus 54.

Figure 3:
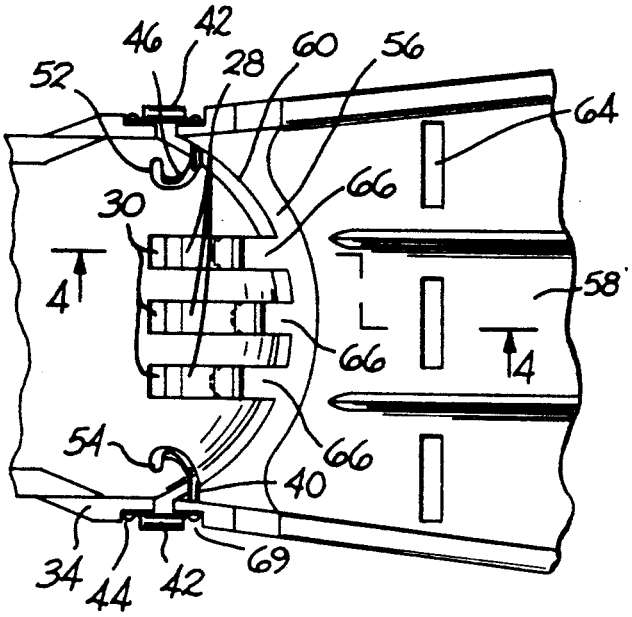
FIG. 3 is a fragmentary top plan view of the fin illustrated in FIG. 1.
Figure 5:
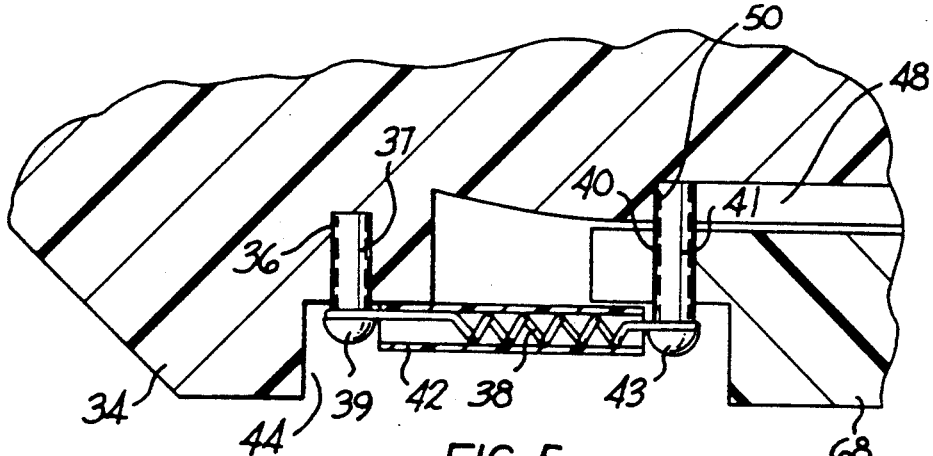
FIG. 5 is a cross sectional view taken substantially along line 5—5 of FIG. 1.

The web portion 14 is an enlarged elongated body having a beveled portion 56 tapering from an upper surface 58 toward an arcuate portion 60 remote from the free end 61 of the web, the portion 60 having a contour substantially identical to that of the bulbous section 24 and is disposed closely adjacent thereto. A plurality of ribs 62 may be formed on the surface 58 for strengthening the web, and a number of vent holes 64 may extend through the web for aiding the swimming action. At the central forward part of the web extending from the central section of the arcuate portion 60, as best illustrated in FIG. 3, are three spaced apart fingers 66, each finger having a width adapted to be received within the respective cavities 30 and 32, and the spacing between adjacent fingers are substantially equal to the spacing between the respective tracks 28. The fingers 66 are integral with the web and because of their configuration and the elastomeric material from which the web is formed, the fingers are resilient. Extending from each side of the web at the end remote from the free end 61 is a respective extension 68. A respective one of the detent pins 40 is embedded in each extension 68 with its axis disposed substantially normal to the longitudinal axis of the web, i.e., the axis of the pins 40 extend laterally, and each pin has a free end portion projecting out the extension and into the guideway 46 as best illustrated in FIG. 5.

When the web is in the swimming position as illustrated in FIG. 1, the pins 40 are seated within the respective ends 50 of the legs 48 of the guideways 46, and when the web is in the walking position as illustrated in FIG. 2, the pins 40 are seated within the respective ends 54 of the legs 52 of the guideways. When the web is in the swimming position, the fingers 66 are in the cavities 32, and when in the walking position the fingers are in the cavities 30. Because the fingers are resilient and because of the resilient attachment of the web to the connecting section, the web may flutter relative to the boot portion during swimming. In order to change from one mode to the other mode, the user merely grasps the web and pulls it away from the bulbous connecting portion until the pins 40 are unseated from the respective terminus 50, 54 and pulled out of the respective leg 48, 52 into the main guideway 46. As this occurs the fingers 66 are pulled out of the respective cavity 30, 32 and enter the tracks 28. As the pins are moved along the guideway, the arcuate portion 60 of the web clears the bulbous section 24 and the fingers drag on the tracks 28. When the pins 40 enter the selected legs 48 or 52 for the selected mode, the fingers 66 enter the appropriate cavity either 30 or 32. The web has been repositioned when the fingers are at the end 50 or 54 of the appropriate leg 48 or 52. The fingers are then disposed within the corresponding cavities. As the fingers 40 move from the seat 50 to the seat 54 and vice versa, the spring 38 and tube 42 move in the space between the recess 44 and a similar recess 69 in the extension 68. Alternatively, the tube 42 may be elastomeric material such as surgical rubber tubing which permits the spring to bend 90° from the disposition during swimming to the disposition during walking.

Accordingly, a swim fin is provided in which the web portion is mounted to a boot portion by means of fingers extending from the web portion and disposed within cavities in the boot portion in both the swimming mode and the walking mode. Spring means are provided so as to permit the web to move relative to the boot portion and to lock the web to the boot portion with the fingers in the respective cavities. A manual force is required to overcome the urging of the springs to relocate the pins 40 and the fingers 66 when changing from one mode to the other.

Although the action of the springs 38 pulling the detent pins 40 tightly into the termini 50 of the legs 48 of the guideways 46 hold the fingers 66 within the cavities 32, it may be desirable to provide additional holding action to preclude disengagement during swimming. Thus, the fingers may have ferrous metal tips 70 which are held in the cavities 32 by means of magnets 72 embedded within the floor of these cavities. This ensures that the kicking force applied on the web will not dislodge the fingers from the cavities while the swimmer is swimming.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A swim fin convertible between a swimming mode and a walking mode comprising: a shoe having an axially elongated foot receiving pocket at one end for receiving a foot of a swimmer and a bulbous connecting member at another end spaced from said pocket, a web member providing an enlarged surface for aiding in providing propulsive thrust to said swimmer while in water, said web having a free end spaced from said connecting member and a second end adjacent said connecting member, a plurality of spaced apart fingers disposed at said second end and extending in a direction remote from said free end, a plurality of spaced apart slots equal in number to the number of fingers formed in said connecting member defining tracks, each track extending from a first terminus at a disposition at an end of said connecting member remote from said one end of said shoe to a second terminus at a disposition substantially 90° thereto adjacent said foot receiving pocket, a finger receiving cavity recessed into said connecting member at each terminus of said track, each cavity at said first terminus having an axis substantially parallel to the axis of elongation of said pocket and each cavity at the second terminus having an axis substantially perpendicular to said axis of elongation, and means for resiliently securing said web to said connecting member and for urging said fingers into respective cavities at said first terminus of said track when said web is in an extended swimming position relative to said shoe and into respective cavities at said second terminus when said web is in a folded walking position upright relative to said shoe, and for permitting said fingers to be removed from the cavities at one terminus and inserted into the cavities at the other terminus.

2. A swim fin as recited in claim 1, wherein said means for resiliently securing said web comprises means defining a pair of spaced apart guideways recessed into said connecting member at opposite sides spaced from said tracks, each guideway including a first leg extending substantially parallel to the axis of elongation of said pocket and terminating in a first seat and a second leg extending substantially perpendicular to said axis of elongation and terminating in a second seat, detent means carried by said web received within each track, and resilient means for urging each detent means toward said shoe for securing said web to said connecting member, said detent means being disposed in said first seat when said fingers are disposed in respective cavities at the first terminus, and said detent means being received within said second seat when said fingers are disposed in respective cavities at said second terminus.

3. A swim fin as recited in claim 2, wherein said fingers comprise elastomeric material and have free ends comprising ferrous metal, and magnets embedded in each cavity at said first terminus for aiding in securing said web in the swimming position.

4. A swim fin as recited in claim 2, wherein each detent means comprises a pin fastened to said web and extending into a respective guideway.

5. A swim fin as recited in claim 4, wherein said resilient means comprises a coil spring having a first end fastened to said shoe and a second end fastened to said detent means

6. A swim fin as recited in claim 5, wherein said bulbous connecting member has an arcuate surface at least in the vicinity of said tracks, and said tracks have arcuate configurations intermediate said first and second termini.

7. A swim fin as recited in claim 6, wherein said second end of said web includes an arcuate surface disposed adjacent the arcuate surface of said connecting member and spaced therefrom while said detent means is in either the first or second seat.

8. A swim fin as recited in claim 1, wherein said bulbous connecting member has an arcuate surface at least in the vicinity of said tracks, and said tracks have arcuate configurations intermediate said first and second termini.

9. A swim fin as recited in claim 8, wherein said second end of said web includes an arcuate surface disposed adjacent the arcuate surface of said connecting member and spaced therefrom.

10. A swim fin as recited in claim 1, wherein at least a portion of said connecting member comprises a segment of a sphere, said track defining slots being disposed in said segment.

* * * * *